United States Patent [19]

Woods

[11] 4,086,103

[45] Apr. 25, 1978

[54] ACCELERATOR FOR PHOSPHATING SOLUTIONS

[76] Inventor: Kevin James Woods, 66 Heathmont Road, Heathmont, Victoria, Australia

[21] Appl. No.: 711,232

[22] Filed: Aug. 3, 1976

[30] Foreign Application Priority Data

Aug. 13, 1975 Australia ..... PC2786

[51] Int. Cl.[2] ..... C23F 7/08

[52] U.S. Cl. ..... 148/6.15 R; 148/6.15 Z

[58] Field of Search ..... 148/6.15 R, 6.15 Z

[56] References Cited

U.S. PATENT DOCUMENTS

| | | | |
|---|---|---|---|
| 2,132,883 | 10/1938 | Romig | 148/6.15 Z |
| 2,591,479 | 4/1952 | Ward | 148/6.15 Z |
| 3,144,361 | 8/1964 | Klinghoffer | 148/6.15 Z |

FOREIGN PATENT DOCUMENTS

| | | | |
|---|---|---|---|
| 679,869 | 9/1952 | United Kingdom | 148/6.15 |

*Primary Examiner*—Ralph S. Kendall

*Attorney, Agent, or Firm*—Cushman, Darby & Cushman

[57] ABSTRACT

A method for accelerating the formation of a zinc or manganese phosphate coating on a metal substrate, which method comprises dissolving gaseous nitrogen peroxide in an acidic zinc or manganese phosphate coating solution and contacting the metal substrate with the solution so produced.

6 Claims, 2 Drawing Figures

ACCELERATOR FOR PHOSPHATING SOLUTIONS

Figure 1:
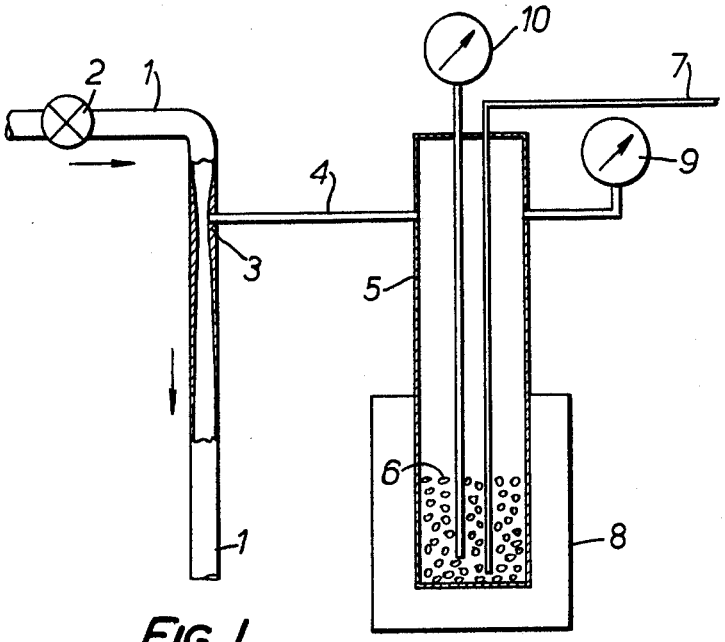

This invention relates to the formation of zinc and manganese phosphate coatings on metal substrates; more particularly, to a method for accelerating such formation using a new type of accelerator.

The formation of zinc phosphate coatings on metal surfaces such as iron in order to minimize corrosion, to provide improved adhesion of paints, lacquers and other siccative coatings, and to provide improved lubrication of metal surfaces in cold forming operations, is an old art in which many refinements have been made over the years. The coating process basically involves dipping or spraying the metal substrate in or with a solution made by dissolving zinc phosphate and phosphoric acid in water together with nitric acid and other additives. The solution is usually held at an elevated temperature within the range of 100° to 200° F during the coating process while the concentrations of the various chemical constituents are maintained within set predetermined limits.

Manganese phosphate coatings are commonly applied by dipping processes at 160°–200° F and are frequently used under oil, particularly for wearing surfaces, but may also be applied by spray and used under siccative coatings.

One of the main tasks with which researchers in the phosphate coating industry have been and are presently engaged in, is the provision of means for accelerating the formation of such coatings. A number of methods have been advanced for achieving this and the most extensively used methods involve the use of substances classed as accelerators. These accelerators are added to the coating solution in carefully worked out quantities and function as depolarizers and metal oxidizers. The exact reaction mechanisms by which these accelerators influence the formation of the phosphate coating are extremely complicated and will not be entered into here in any detail. Typical of such accelerators are the nitrates, nitrites, bromates, chlorates and peroxides. The accelerators in most common use and by far the more preferred are the nitrate and nitrite ions which are added to the phosphating solution in the form of nitric acid, sodium nitrate or sodium nitrite. These ions are employed together where light weight paint base type coatings are required, these being a major type of coating with which industry is concerned, and can be applied in the very short time of approximately one minute. The main metal which is phosphatized is iron and the primary reaction at the iron surface is as follows:

$$Fe + 2H^+ \rightarrow Fe^{2+} + H_2\uparrow$$

The addition of nitrite renders the phosphatizing solution free from ferrous ion by oxidizing it to ferric ion which precipitates as the insoluble ferric phosphate. The nitrate and nitrite effect a depolarizing action by oxidizing to water the hydrogen that would otherwise be liberated at the metal surface and additionally accelerate the coating reaction by forming the mixed oxide/-phosphate layer on which the zinc phosphate coating is built. While the combination of nitrate/nitrite has been found to be by far the most preferred accelerator for zinc phosphating solutions, it does, nevertheless, have a number of disadvantages. These disadvantages primarily arise due to the sodium nitrite. In acid solution sodium nitrite is decomposed as follows:

$$2NO_2^- + 2H^+ \rightarrow NO_2\uparrow + NO\uparrow + H_2O$$

To an extent determined by the degree of agitation of the phosphating solution, a large amount of the nitrogen oxides so produced are lost to the atmosphere with the result that substantial quantities of replenishment sodium nitrite must be continuously added to the phosphating solution. Furthermore, in view of the concurrent depletion of an equivalent amount of acid in the above reaction, replenishment acid, usually in the form of nitric acid, must also be continuously added to the solution. This leads to a build up of sodium nitrate and other sodium salts in the phosphating solution with the result that automatic conductivity control is not practicable. There is a further substantial disadvantage as the operating pH tends to be determined by the relative quantity of sodium nitrite added rather than by the best operating condition for phosphate coating formation.

A further disadvantage is the precipitation of some zinc phosphate as sludge due to the sodium nitrite being continuously added to the phosphating solution in excess.

It is therefore an object of the invention to provide a new method for accelerating the formation of phosphate coatings on metal substrates, which method has the advantages of rapidly producing light weight coatings but does not result in the disadvantages associated with the use of sodium nitrite as previously described.

It has now been unexpectedly found that this objective can be achieved by adding gaseous nitrogen peroxide to the phosphating solution instead of, or in addition to, the conventional solid/liquid type oxidizers and depolarizers. Ideally, the gaseous nitrogen peroxide may be employed as a substitute for sodium nitrite in the sodium nitrate/sodium nitrite accelerated phosphating solution previously referred to, but it may be employed in most conventional conversion coating solutions. By "conventional" is meant a solution containing the basic ingredients for phosphating, viz. zinc or manganese phosphate dissolved in an aqueous phosphoric acid solution either with or without other additives.

When used in place of sodium nitrite, nitrogen peroxide is added to directly replace the nitrogen oxides lost to the atmosphere. There is consequently no requirement for an equivalent amount of nitric of other acid in the replenishment phosphate solution with consequent significant reduction in processing costs. Furthermore, there is no unwanted build-up of sodium nitrate and other sodium salts in the phosphating solution so that automatic conductivity control is possible. There is the further advantage that the loss of zinc phosphate from the solution as sludge due to the alkaline effect of excess sodium nitrite is eliminated with consequent savings both directly in the cost of zinc phosphate and indirectly in the less frequent desludging operations required where these are done manually. When accelerating with nitrogen peroxide, sludge formation is confined essentially to ferric phosphate and the rate of formation of this may itself by reduced by operating the solution at the optimum pH.

There is however a tendency for some of the nitrogen peroxide to form nitric acid when introduced into the phosphating solution. The formation of nitric acid may be significant in spray applications where the nitrogen peroxide addition rates required to offset losses, becomes relatively large. The excess acidity which thereby results may be neutralised with alkali such as sodium carbonate, but is preferably neutralised by allowing the phosphating solution to flow over a zinc surface which serves to maintain the desired level of acidity and provide a portion of the replenishment chemical at the same time.

Accordingly, the present invention provides a method for accelerating the formation of a zinc or manganese phosphate coating on a metal substrate, which method comprises dissolving gaseous nitrogen peroxide in an acidic zinc or manganese phosphate coating solution and contacting the metal substrate with the solution thus produced.

The invention also extends to metal substrates whenever coated by a zinc or manganese phosphate coating by the present process.

The method finds its principal application in connection with ferriferous surfaces such as iron and steel, but it can also be used with other types of metals and alloys such as zinc, galvanized iron and aluminium.

The nitrogen peroxide gas may be introduced into the phosphate coating solution by any convenient means such as, for instance, by bubbling or aspirating the gas through the solution. The gas may be provided directly from storage cylinders or may be produced immediately before use by any one of a number of well known methods. Such methods include heating nitric acid above 256° C; heating nitrate salts such as lead nitrate above their decomposition temperatures; heating ammonia with air over a platinum gauze at 760°-900° C and combining the nitric oxide obtained with oxygen, passing air through an electric arc and reacting the product thus obtained with oxygen; and combining nitric oxide from storage cylinders with oxygen.

Ions from the metal being treated may be present in the phosphate coating solution and additives which may optionally be present include ferrous ions, ferric ions and the ions of copper, nickel, calcium, sodium, ammonium, lead fluoride, silicofluoride, fluoborate, fluotitanate, fluozirconate, chloride, sulphate, oxalate, glycerophosphate, tartrate, citrate and complex phosphate. Wetting agents and sludge flocculating agents, as well as conventional accelerators, may also be present.

Figure 2:
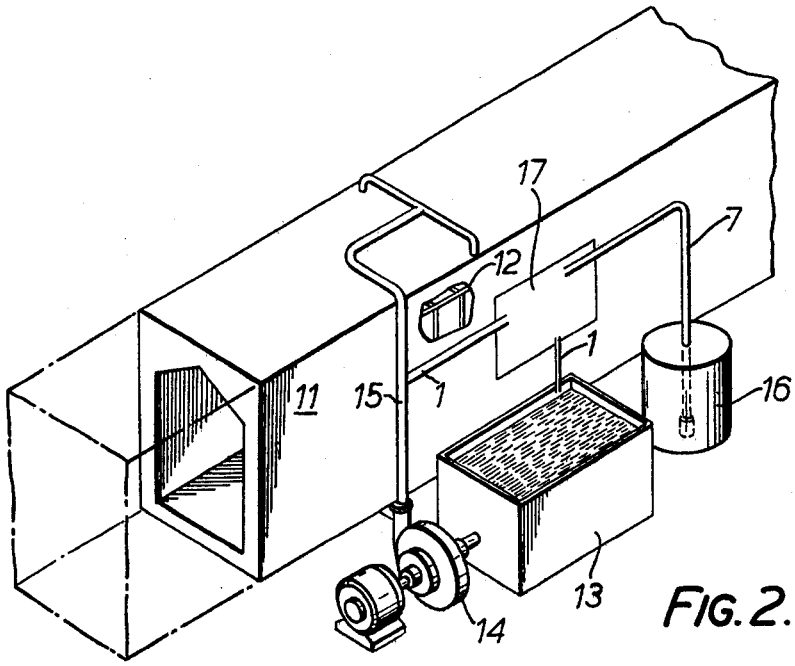

Preferred features of the invention will now be described with reference to the accompanying drawings, in which:

FIG. 1 is a diagrammatic view of a system for generating and introducing nitrogen peroxide into a phosphate coating solution; and FIG. 2 is a diagrammatic view showing the relationship between the system illustrated in FIG. 1 and a conventional spray phosphating plant.

Firstly referring to FIG. 1, a closed loop solution take-off and recirculation line 1 draws phosphating solution from a phosphating bath and returns it to the bath in the direction indicated by the arrows. The solution is circulated through the line 1 by means of a mechanical pump which may be separately provided for this purpose, or alternatively, a by-pass line may be taken from an existing spray pump as shown in FIG. 2.

The recirculation line 1 has a control valve 2 and an "in-line" venturi type aspirator pump 3 constructed from stainless steel or acid resisting plastic which applies a partial vacuum through the stainless steel connecting tube 4. The connecting tube opens into a stainless steel reactor vessel 5 in which gaseous nitrogen peroxide is produced. The reactor vessel has a stainless steel inlet tube 7 through which concentrated nitric acid is led through a bed of coarse inert particulate matter 6 to the bottom of the vessel. The lower part of the vessel is mounted in an electric furnace 8.

In operation, phosphating solution from the phosphating bath is circulated through recirculation line 1 by means of the mechanical pump. As the solution circulates, the aspirator pump 3 produces a reduction in pressure in the connecting tube 4. This gives rise to a reduced pressure in the reactor vessel 5 as shown on the gauge 9 and nitric acid is sucked into the vessel through inlet tube 7. As the nitric acid is drawn into the vessel, it meets the solid particulate matter 6 which has been heated by the electric furnace to a temperature of approximately 300° C as shown on the gauge 10. This results in immediate decomposition of the nitric acid to produce nitrogen peroxide according to the following equations:

$$4HNO_3 \rightarrow 2H_2O + 4NO_2 + O_2$$

$$2NO_2 \rightleftarrows N_2O_4$$

The nitrogen peroxide thus produced is drawn into the circulating phosphating solution in recirculation line 1 and is transported to the phosphating bath.

FIG. 2 shows the apparatus illustrated in FIG. 1 incorporated into spraying equipment of the type widely used in the art. 11 is a spray chamber having a system of piping to distribute the solution through a multiplicity of spray nozzles, shown at 12, past which the articles being treated are carried on a conveyor. The reservoir for the phosphating solution is shown at 13. A motor driven pump 14 withdraws solution from the reservoir and delivers it through the pipe 15 and branch pipes inside the spray chamber to the nozzles shown partially at 12. The floor of the spray chamber is open to permit the return of the sprayed solution to the reservoir.

The by-pass line 1 circulates process solution through the nitrogen peroxide generating equipment 17, detailed in FIG. 1, back to the reservoir. The line 7 connects a drum of nitric acid 16 to the nitrogen peroxide generating equipment.

EXAMPLE 1

An apparatus was assembled as shown in FIG. 1. A zinc phosphating solution was prepared as follows:

Zinc carbonate — 63 grams
Phosphoric acid (75%) — 175 grams
Water — to 10 liters A pump was provided to circulate the solution. The line 7 was fitted with a 3 cm length of narrow bore stainless steel tubing, approximately 0.2mm internal diameter, to restrict the flow rate of nitric acid to the desired level of about ¾ ml/min. which was achieved when the control valve 2 was adjusted to give a flow rate of about 2 liters/min. through the recirculation line 1; under these conditions the apparatus was found to draw air at a rate of 1½ liters/min. when the inlet line 6 was opened to atmosphere.

The solution was then heated to 60° C and 15 ml. of nitric acid (70%) were drawn through the apparatus over a period of about 20 minutes, converted to nitrogen peroxide and transported into the phosphating solution. When the solution was tested with starch iodide paper, an intense blue colour developed; no colour was produced on starch iodide paper before the nitrogen peroxide was introduced. Steel specimens were immersed in the solution and fine tight hard coatings of zinc phosphate were formed.

EXAMPLE 2

The same procedure as in Example 1 was followed with the exception that 25 ml of a 400 gram/liter solution of sodium nitrite was added to the phosphating solution. The solution imparted a blue colour to starch iodide paper of similar intensity to that obtained with the nitrogen peroxide and steel specimens immersed in the solution gave similar fine hard tight coatings.

EXAMPLE 3

The apparatus of FIG. 1 was modified by eliminating control valve 2 and by terminating the nitric acid supply line 7 at the bottom of an open vessel. A supply system was set up to drip feed nitric acid (70%) at the rate of 5 drops per minute into the open vessel from where it was drawn through supply line 7 into the generator and thence into the operating bath. The apparatus was used to feed a 25 liter bath of a zinc phosphating solution which was being circulated through an arrangement of eight nozzles which allowed the solution to flow over test panels before returning to the holding tank.

The composition of the zinc phosphating solution was:

zinc oxide — 80 grams
phosphoric acid (76%) — 120 grams
nitric acid (70%) — 70 grams
water — To 25 liters Sufficient sodium carbonate was added to reduce the free acid titration to about 0.8 ml determined by titrating a 10 ml sample of the bath with 0.1N sodium hydroxide to the bromphenol blue end-point.

The bath was maintained at a temperature between 50° and 55° C while the nitrogen peroxide was introduced for ½ hour. The nitrogen oxide concentration was estimated by titrating a 25 ml sample with 0.1N potassium permanganate after adding 1 ml of sulphuric acid (50%). It was found that the titration rose from less than 0.1 ml to 5.1 ml during the ½ hour period of the test. Cleaned steel panels were then introduced in front of the nozzles and a hard fine tight coating of zinc phosphate crystals was formed.

EXAMPLE 4

The process described in Example 3 was continued for several hours. The nitrogen oxide titration remained at about 1.5 ml. The free acid slowly rose to 2.3 ml. At this higher free acid level, sparse, thin unsatisfactory coatings were obtained.

EXAMPLE 5

The process of Example 4 was repeated after installing a perforated tray containing slugs of zinc metal which provided a total surface area of about 0.015 square meter. The solution from the sprays flowed over this zinc before returning to the holding tank. The free acid titration was maintained at 1.1 ml and the nitrogen oxide titration at 1.5 ml which gave satisfactory zinc phosphate coatings.

EXAMPLE 6

An industrial plant similar to that shown in FIG. 2 and processing about 20 square meters of steel surface per hour was converted from the use of sodium nitride accelerator to nitrogen peroxide. The zinc phosphate bath contained about 0.18% zinc, gave a total acid pointage of 12 ml determined by titrating a 10 ml sample with 0.1N sodium hydroxide tc phenolphthalein, and was operated at a temperature of about 45° C.

Nitric acid (70%) was supplied to the nitrogen peroxide generator shown in FIG. 1 by a positive displacement metering pump through supply line 7. The generated nitrogen peroxide was forced through the connecting tube 4 into the venturi system 3 and thence into the operating bath. The nitric acid was fed at a rate of about 20 ml per minute into the 3500 liter bath for eight hours. After ¾ hour, the nitrogen oxide titration reached 1.0 ml and steel parts processed through the sprays gave good zinc phosphate coatings. The free acid of the solution was 1.0 ml after ¾ hour and rose slowly to 1.4 ml after three hours when additions of soda ash were made to re-establish satisfactory processing conditions.

EXAMPLE 7

Employing the system described in Example 6, a 23 kg coil of 0.3 cm diameter zinc wire was spread beneath the sprays so that the solution flowed over it when returning to the bath. The nitrogen oxide titration rose to 1.1 ml after 1 hour and remained at this value for the 8 hours of the experiment. The free acid rose from 0.8 to 1.1 during the eight hours and satisfactory zinc phosphate coatings were obtained during this period. During the eight hours, ½ liter of zinc phosphate replenisher was added to maintain the total acid pointage at 12 ml and about 10 liters of nitric acid to maintain the nitrogen oxide titration. When operated using sodium nitrite, 12 liters of zinc phosphate replenisher were needed for a similar eight hours production together with 10 liters of sodium nitrite solution (40%).

EXAMPLE 8

Substantially the same system as described in Example 7 was used, with the only changes being the elimination of the venturi pump 3 and the introduction of the connecting tube 4 directly into the operating solution. After 1 hour, the nitrogen oxide titration had risen to 0.8 ml and the free acid to 1.5 ml. Zinc phosphate coatings formed on test panels were sparse and unsatisfactory. This effect is attributed to the tendency for nitrogen peroxide to convert to an increased extent to nitric acid when it is present in localised high concentrations.

EXAMPLE 9

Substantially the same system as described in Example 7 was used, with the only change being the replacement of the venturi pump 3 with a 20 cm stainless steel tee through which the operating solution was pumped at a rate of about 50 liters per minute. The nitrogen peroxide was fed into this stream through a relatively narrow bore tube. Test results were identical with those obtained in Example 7.

EXAMPLE 10

A zinc phosphating solution was prepared with the following composition:

zinc oxide — 4.0 grams
phosphoric acid (75%) — 8.8 grams
nitric acid (70%) — 5.0 grams
water — to 500 ml The solution was heated to 35° C and clean steel panels were introduced into it for 2 minutes. No visible coating was formed.

The vessel holding the solution was partially evacuated and connected to a commercial gas cylinder of nitrogen peroxide in such a way that sufficient nitrogen peroxide was introduced to produce a strong blue colour on starch iodide test paper. The nitrogen peroxide cylinder was then disconnected and clean steel test panels were introduced into the solution for 2 minutes. A fine tight zinc phosphate coating was formed.

EXAMPLE 11

A manganese phosphating solution was prepared with the following composition:

Manganese carbonate — 5.7 grams
Phosphoric acid (75%) — 17.6 grams
Water — to 500 ml The solution was heated to 55° C and clean steel panels were introduced into it for 2 minutes. No visible coating was formed.

Nitrogen peroxide was introduced into the solution from a gas cylinder using the procedure described in Example 10. Clean steel test panels were again introduced into the solution for 2 minutes when light weight adherent coating formed.

I claim:

1. A method for accelerating the formation of a zinc or manganese phosphate coating on a metal substrate, which method comprises dissolving gaseous nitrogen peroxide in an acidic zinc or manganese phosphate coating solution and contacting the metal substrate with the solution so produced.

2. A method as claimed in claim 1, wherein the phosphate coating solution also contains: iron, copper, nickel, calcium, sodium, ammonium, lead, fluoride, silicofluoride, fluoborate, fluotitanate, fluozirconate, chloride, sulphate, oxalate, glycerophosphate, tartrate, citrate, or complex phosphate ions.

3. A method as claimed in claim 1, wherein the gaseous nitrogen peroxide is bubbled or aspirated into the phosphate coating solution.

4. A method as claimed in claim 3, wherein the gaseous nitrogen peroxide is aspirated into the phosphate coating solution by means of a venturi pump.

5. A method as claimed in claim 1, wherein the metal substrate is a ferriferous surface.

6. A method as claimed in claim 1 and wherein the metal substrate is contacted by the phosphate coating solution by dipping the substrate in the solution or by spraying the solution onto the substrate.

* * * * *